US005174380A

United States Patent [19]

Marcotte

[11] Patent Number: 5,174,380

[45] Date of Patent: Dec. 29, 1992

[54] GAS VENTING APPARATUS

[75] Inventor: Jerry J. Marcotte, Jeanerette, La.

[73] Assignee: Texaco Inc., White Plains, N.Y.

[21] Appl. No.: 772,315

[22] Filed: Oct. 7, 1991

[51] Int. Cl.[5] ..... E21B 29/00

[52] U.S. Cl. ..... 166/335; 166/75.1

[58] Field of Search ..... 166/335, 75.1, 84, 85, 166/95

[56] References Cited

U.S. PATENT DOCUMENTS 3,339,632 9/1967 Lewis ..... 166/335

3,662,822 5/1972 Wakefield, Jr. ..... 166/335

*Primary Examiner*—Thuy M. Bui

*Attorney, Agent, or Firm*—Robert A. Kulason; James J. O'Loughlin; Robert B. Burns

[57] ABSTRACT

A gas venting apparatus for an offshore installation which vents excess gas produced from a liquid producing well. Said apparatus, including a flame extinguishing feature comprised of an elongated tube which depends from the flow tip of a gas venting conductor. To extinguish an accidentally ignited gas-fed flame, and to concurrently cool the flow tip, a weighted closure plate assembly is maintained in open position at the conductor flow tip. A high velocity stream of water directed against the closure assembly urges a closure plate into sealing engagement with the gas conductor, thereby choking off the flame, and terminating the gas flow.

7 Claims, 1 Drawing Sheet

GAS VENTING APPARATUS

BACKGROUND OF THE INVENTION

Virtually, any well which produces liquid hydrocarbons such as crude oil, also produces a residual amount of natural gas and water. In the normal production or drilling facility, low pressure gas, if present in a limited quantity, is discharged into the atmosphere rather than being flared, saved or otherwise used for commercial purposes.

In the instance of offshore producing facilities, this residual gas is dissipated into the air by way of one or more flare booms which extend outwardly from the offshore structure. A flare booms is normally furnished to each offshore platform such that vented gas is carried away from the platform by prevailing wind, rather than being blown back onto the structure. When the gas is at a relatively low pressure, it is merely vented rather than being flared.

The term vent gas as herein utilized refers to that portion of the gas which is raised from a producing operation, but is at an insufficient pressure and/or insufficient quantity to warrant being conserved.

Since this residual natural gas is combustible and normally combustion supporting, it can constitute a danger to the platform from a safety consideration as well as a health consideration for the workers.

Once the gas enters the atmosphere it will as a rule become sufficiently diluted to be safe from further ignition. Even so, the gaseous mixture formed at the vent boom discharge port can be readily ignited into an open flame by natural causes such as by a flash of lightening. Offshore platforms or structures are normally isolated in a body of water. It stands to reason that in the event of an electrical storm, the accompanying lightning could constitute a flame-triggering medium for the vented gaseous mixture.

As a practical matter, in the Gulf of Mexico it is not an uncommon event for the vented gas to be ignited by lightning during an electrical storm. To extinguish the resulting flame however, often constitutes a difficult and dangerous procedure due to the vent boom structure extending outwardly over the water, and the lack of a convenient mechanism for extinguishing the flame. Further, such booms are normally installed at an angle of about 30° to horizontal such that the vent gas stream will be released in an upward direction.

BRIEF STATEMENT OF THE INVENTION

Toward overcoming this potential danger to the well-being and safety of offshore platform workers, as well as to the structure itself, the present invention provides means for promptly extinguishing a gas fueled flame. It further provides means for impinging a pressurized stream of fluid against a pivotally mounted closure member whereby to choke off a gas flame from a vent conduct. Said closure member is operably positioned on the vent conductor to be displaced, thereby to sealably engage the gas venting discharge port. Concurrently, the displacing fluid, usually in liquid form, cools the conductor tip to avoid a flame being re-established as a result of contact with hot surfaces.

It is therefore an object of the invention to provide a rapid, efficient means for extinguishing an open flame which has been accidently ignited at the discharge port of a gas venting apparatus.

DESCRIPTION OF THE DRAWINGS

Referring to FIG. 1, a flare boom or gas venting boom 10 of the type contemplated is shown extending from one side of an offshore platform 11 which is generally isolated from other platforms in a body of water 12. Platform 11 comprises a structure formed basically of a working deck 13 which is supported above the water's surface by one or more legs 14. The latter are normally aligned in a substantially upright disposition, the lower ends being embedded into the substrate 16 to a sufficient depth to assure stability of the platform.

During a normal hydrocarbon producing operation, the combined production flow of liquid crude oil, together with an amount of water and an amount of reservoir gas, will be conducted to deck 13 by at least one, and preferably by a series of risers 17. The latter communicate with a subterranean reservoir 18 holding the fluid being produced.

At deck 13, the production flow will be initially processed by introduction to a separator (not shown) which physically segregates a major part of the water and the crude oil, from vent gas. The gas is then passed into the atmosphere by way of one or more vent gas booms 10 which extend outwardly and overhangs the water.

Figure 1:
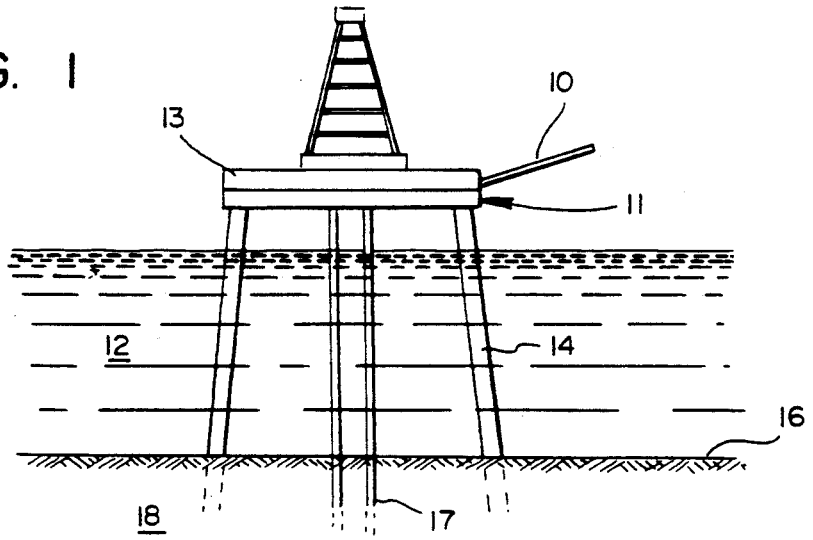
FIG. 1 is an environmental view of the gas venting apparatus presently disclosed, as used on an offshore platform or structure.
Figure 2:
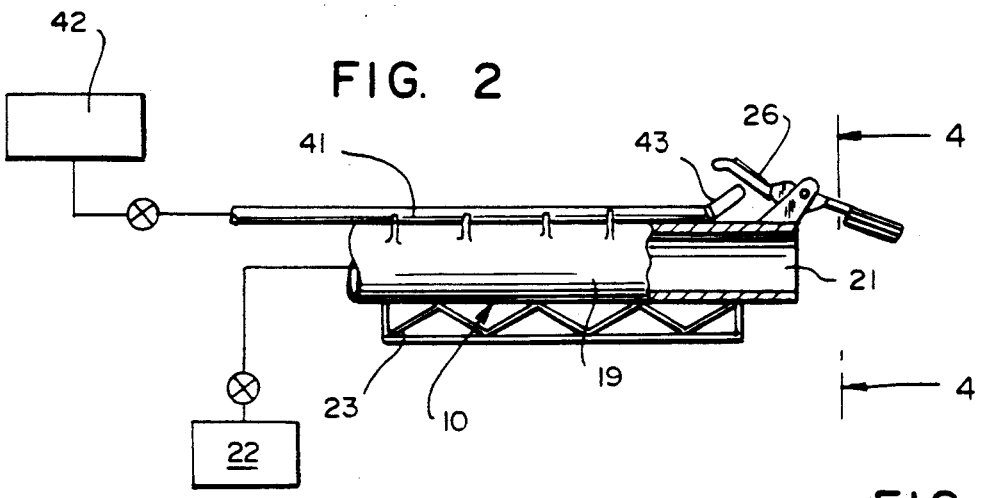
FIG. 2 is an enlarged segmentary view of the apparatus, shown in FIG. 1.
Figure 3:
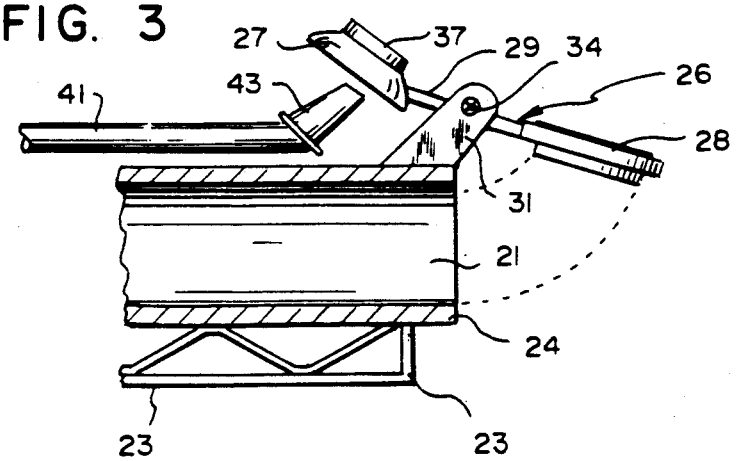
FIG. 3 is an enlarged segmentary view of a port.
Figure 4:
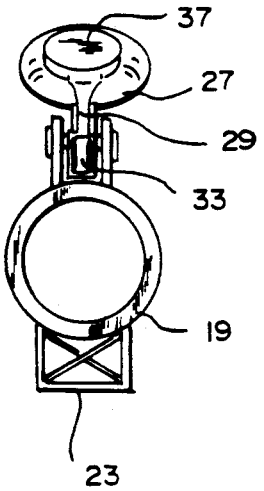
FIG. 4 is an enlarged segmentary view in cross section of the port closure apparatus in FIG. 2.

Basically, a gas venting boom of the type contemplated, is shown in FIG. 2, wherein an elongated vent gas conductor 19 is communicated at its upstream end with a source 22 of the gas to be vented. The latter can be a tank, a reservoir, a liquid separator, or the like. Depending on the volume of gas to be disposed of, conductor 19 can be a pipe or tubing on the order of magnitude of six or more inches in diameter formed of steel or other suitable material.

Vent gas boom 10 normally extends outwardly above the water's surface such that its remote discharge port 21 is positioned about 50 to 100 feet from the platform's deck 13. Discharge port 21, is formed by a peripheral lip 24, which defines an overhang to minimize the amount of rain and ocean spray which enters conductor 19. Lip 25 is formed to best engage the conductor closure element hereinafter mentioned.

Boom 10 is provided with sufficient bracing, or with a support frame 23 to assure its structural integrity particularly in view of the boom's cantilevered relationship with deck 13.

The remote end of vent ga conductor 19 is provided with a tip 24 which as noted includes a circular opening or port 21 through which the flowing gaseous stream emerges. It is at this point that the gaseous stream combines with atmospheric air and becomes a flammable mixture.

The tip or discharge end of conductor 19 is provided with a closure element 26 which is operably positioned on the conductor in a manner that it can be urged into either of two positions, relative to discharge port 21, to fully open or to fully close the latter.

Closure elements 26 in a preferred embodiment is comprised of a central segment 29 which is pivotally engaged to conductor 19. A disk-like target plate 27 depends from one end of the central segment 29 above the conductor 19 surface. A flapper plate 28 at the said segment other end is displaceable from a retracted position, so that in an advanced position it is brought into sealing engagement with vent gas discharge port 21.

In the fully opened position, the closure element flapper plate 27, depends upwardly and forward, from the surface of conductor 19 and is formed in a generally dislike configuration. Said member is provided with a resilient shoulder or rim 36 which can be registered in the conductor discharge opening 21, but is normally sufficiently spaced from the latter to allow unimpeded outflow of vented gas.

To assure a substantially gas-tight sealing relationship when in advanced position, shoulder 36 can be formed of a temperature resistant, yet resilient material. The shoulder is positioned on the contact surface by flapper plate 28 to normally be beyond the path of the vent gas stream, yet registerable in opening 21 when closure element 26 is actuated.

Closure element 26 operably depends from vent conductor 19 by a tab 33 which extends from one side of segment 29. A pair of support arms 31 and 32 dependent from conductor 19 to support said tab 33 at a pivot pin 39.

The actuating medium for the pivotally mounted closure elements 26 is comprised of an elongated conduit 41 which depends preferably from the upper surface of conductor 19, and which is communicated at its inner end with a pressurized source 42 of an inflammable liquid, preferably water. Water source 42 can be pressurized by a pump, gas pressure, or by a similar facility cooperative with said source. Operationally, when a water flow is forced into conduit 41 it is carried along the conduit length and ejected from the latter at high velocity through a discharge nozzle 43. The latter is aligned such that the water stream will impinge against the contiguous surface of target plates 27 thereby urging the latter from its normal retracted position, into the forward position. Said movement will thereby urge shoulder 36 into sealing engagement with the discharge opening 21.

In the withdrawn position, target plate 36 is spaced above conductor 19 with said plate 37 preferably in alignment with nozzle 43. To assure that the closure element 26 is maintained in its retracted position, target plate 27 can be furnished with a counterweight 37 or the like. The latter being sufficiently heavy to resist tendency of the closure element 26 to move downwardly without being actuated, thereby interrupting the flow of vent gas.

In the event of a gas flame being ignited at opening 21, a pressurized stream of water, actuated manually or automatically, issues from nozzle 43 to impinge against target plate 27 to urge the latter into its displaced position. To avoid a sealed engagement of flapper plate 28 across opening 21 and the consequent extinguishing of the gas flame, the resilient shoulder will be sealably deformed against lip 24 of discharge port 21.

It is understood that although modifications and variations of the invention can be made without departing from the spirit and scope thereof, only such limitations should be imposed as are indicated in the appended claims.

We claim:

1. In an apparatus for venting a stream of gas into the atmosphere, said apparatus comprising an elongated gas conductor communicated at one end with a source of the gas to be vented, and having a discharge port at the other end to conduct said stream of gas therefrom, the improvement therein of a flame extinguishing means comprising:

an elongated conduit communicated at one end with a pressurized source of a non-flammable liquid, and having a discharge nozzle, a closure member operably depending from said conductor, being displaceable from a normal withdrawn position, to a displaced position in sealing engagement with said discharge port to terminate gas stream flow therefrom, and a target plate depending from said closure member in alignment with said elongated conduit discharge nozzle, said closure member being displaceable to urge said closure member into sealing engagement with said conductor discharge port when said target plate is impinged on by a flow of said pressurized non-flammable liquid.

2. In the apparatus as defined in claim 1, wherein said pressurized source of non-flammable liquid is water.

3. In the apparatus as defined in claim 1, wherein said target plate is of a sufficient weight to maintain said closure member spaced from said conductor discharge opening.

4. In the apparatus as defined in claim 3, wherein said target plate includes a counterweight depending therefrom to maintain said closure member in the normal withdrawn position.

5. In the apparatus as defined in claim 1, wherein said target plate is normally positioned in abutment with said elongated conduit discharge nozzle.

6. In the apparatus as defined in claim 1, including a sealing material on said closure member for sealably engaging said conductor discharge port.

7. In the apparatus as defined in claim 6, wherein said sealing member is formed of a flame resistant material.

* * * * *